US011436948B2

(12) United States Patent
Hatchell et al.

(10) Patent No.: US 11,436,948 B2
(45) Date of Patent: Sep. 6, 2022

(54) MODULAR VISUAL INDICATOR DISPLAY DEVICE

(71) Applicant: Anthony Keith Hatchell, Nashville, TN (US)

(72) Inventors: Anthony Keith Hatchell, Nashville, TN (US); Stanley Kurt Whitehill, Nashville, TN (US); Robert Clair Ogilvie, Nashville, TN (US)

( * ) Notice: Subject to any disclaimer, the term of this patent is extended or adjusted under 35 U.S.C. 154(b) by 981 days.

(21) Appl. No.: 16/056,657

(22) Filed: Aug. 7, 2018

(65) Prior Publication Data

US 2020/0051464 A1 Feb. 13, 2020

(51) Int. Cl.
*G09F 7/08* (2006.01)
*G09F 7/18* (2006.01)

(52) U.S. Cl.
CPC ..... *G09F 7/08* (2013.01); *G09F 7/18* (2013.01); *G09F 2007/1843* (2013.01); *G09F 2007/1891* (2013.01)

(58) Field of Classification Search
CPC ..... G09F 7/10; G09F 7/02; G09F 7/18; G09F 3/20; G09F 3/201; B42F 17/343
See application file for complete search history.

(56) References Cited

U.S. PATENT DOCUMENTS 3,991,495 A * 11/1976 Wilson ..... G09F 11/30 40/594
4,679,341 A 7/1987 Goldman
5,267,405 A * 12/1993 Seggerson ..... G09F 7/10 40/657
D620,052 S 7/2010 Blue et al.
8,127,478 B2 3/2012 Blue et al.
8,245,423 B2 8/2012 Goslee
8,484,872 B2 7/2013 Blue et al.
8,601,729 B2 12/2013 Pitcher et al.
8,695,254 B2 4/2014 Bell et al.
9,015,975 B2 * 4/2015 Blue ..... G09F 7/10 40/649
9,305,468 B2 * 4/2016 Jacobson ..... G09F 7/10
9,424,763 B2 * 8/2016 Blue ..... G09F 7/10
9,595,212 B2 3/2017 Jacobson
2015/0170555 A1 6/2015 Diduch et al.
2015/0269873 A1 9/2015 Rowe et al.

* cited by examiner

*Primary Examiner* — Cassandra Davis
(74) *Attorney, Agent, or Firm* — Robinson IP Law, PLLC

(57) ABSTRACT

A modular flag display includes: a base; a plurality of modular indicator units removably attached to the base, the plurality of modular indicator units including a slide housing attachable to the base, the modular indicator unit including an open end formed thereon; a slide located within the slide housing and extending at least partially from the open end of the slide housing, the slide including a visual indicator viewable on the slide, wherein the slide is movable between an open position such that the visual indicator is visible outside of the slide housing and a closed position wherein the visual indicator is hidden within the slide housing. Each of the plurality of modular indicator units is modular such that the plurality of modular indicator units may be in varying locations on the based.

20 Claims, 17 Drawing Sheets

MODULAR VISUAL INDICATOR DISPLAY DEVICE

FIELD

This disclosure relates to the field of signs and visual indicators. More particularly, this disclosure relates to a flag display that is modular and may be installed in a variety of configurations.

BACKGROUND

Signs and visual indicators are often used to convey important information about a particular location. For example, in a hospital environment, various indicators may be displayed outside of a patient room to provide information to those entering the room regarding any requirements or precautions of patients within the patient room. In some instances, federal law requires that precautionary indicators be displayed outside of a patient room for the safety of the patient. The precautions and other messages to be displayed outside of a room frequently vary depending on the particular patient and other information requirements.

Various signage devices exist that allow for visual indicators such as precautions to be displayed outside of a room. Some of these devices allow one or more of the visual indicators to be displayed or hidden depending on requirements of an adjoining room or area. For example, indicators may be movable such that they slide in or out to reveal information. However, many of these devices may be cumbersome to operate, and are only capable of providing a fixed and limited number of signs or visual indicators for display from the device. This limits the amount and type of information that may be displayed on the device and reduces a likelihood that the sign will be used to display important information.

What is needed, therefore, is an improved flag display device that is modular such that various configurations of signs and visual indicators may be displayed adjacent to a room, and that is further easy to operate when signs and visual indicators are to be changed.

SUMMARY

The above and other needs are met by a modular visual indicator device that is adaptable to multiple configurations. In a first aspect, a visual indicator display device includes: a base; a plurality of modular indicator units removably attached to the base, the plurality of modular indicator units including a slide housing attachable to the base, the modular indicator unit including an open end formed thereon; a slide located within the slide housing and extending at least partially from the open end of the slide housing, the slide including a visual indicator viewable on the slide, wherein the slide is movable between an open position such that the visual indicator is visible outside of the slide housing and a closed position wherein the visual indicator is hidden within the slide housing.

In one embodiment, the visual indicator display device further includes a notch formed on an underside of the slide and an upwardly extending tab formed on the slide housing, wherein the upwardly extending tab engages the notch of the slide when the slide is in the open position to lock the slide in the open position. In another embodiment, the slide further includes an upwardly curved end located on an end of the slide that extends out of the slide housing. In yet another embodiment, the upwardly extending tab contacts the upwardly curved end of the slide to prevent the slide from freely moving to the open position.

In one embodiment, the slide is resiliently flexible and wherein the slide is disengaged from the upwardly extending tab by deforming the slide relative to the slide housing. In another embodiment, the notch of the slide and the upwardly extending tab of the slide housing are biased towards securing the slide in the open position.

In yet another embodiment the slide further including a pocket formed therein for receiving a visual indicator within the pocket. In one embodiment, the slide further including an aperture formed through the pocket of the slide behind the visual indicator. In another embodiment, the slide further includes a lip formed along sides of the pocket for retaining the visual indicator within the pocket.

In one embodiment, the slide housing further includes one or more posts extending outwardly therefrom, the one or more posts shaped to engage one or more corresponding holes formed in the base. In another embodiment, the one or more holes formed in the base are arranged to receive the posts of the plurality of modular indicator units in a plurality of locations on the base.

In a second aspect, a visual indicator display device includes: a base; a plurality of modular indicator units removably attached to the base, the plurality of modular indicator units including a slide housing attachable to the base, the modular indicator unit including an open end formed thereon; a slide located within the slide housing and extending at least partially from the open end of the slide housing, the slide including a visual indicator viewable on the slide, wherein the slide is movable between an open position such that the visual indicator is visible outside of the slide housing and a closed position wherein the visual indicator is hidden within the slide housing; a notch formed on an underside of the slide and an upwardly extending tab formed on the slide housing, wherein the upwardly extending tab engages the notch of the slide when the slide is in the open position to lock the slide in the open position.

In one embodiment, the slide further includes an upwardly curved end located on an end of the slide that extends out of the slide housing. In another embodiment, the upwardly extending tab contacts the upwardly curved end of the slide to prevent the slide from freely moving to the open position. In yet another embodiment, the notch of the slide and the upwardly extending tab of the slide housing are biased towards securing the slide in the open position.

In one embodiment, the slide is resiliently flexible and wherein the slide is disengaged from the upwardly extending tab by deforming the slide relative to the slide housing.

In another embodiment, the slide further includes a pocket formed therein for receiving a visual indicator within the pocket. In yet another embodiment, the slide further includes an aperture formed through the pocket of the slide behind the visual indicator. In one embodiment, the slide further including a lip formed along sides of the pocket for retaining the visual indicator within the pocket.

In a third aspect, a visual indicator display device includes: a base; a plurality of modular indicator units removably attached to the base, the plurality of modular indicator units including a slide housing attachable to the base, the modular indicator unit including an open end formed thereon; a slide located within the slide housing and extending at least partially from the open end of the slide housing, the slide including a visual indicator viewable on the slide and an upwardly curved end located on an end of the slide that extends out of the slide housing, wherein the slide is movable between an open position such that the visual indicator is visible outside of the slide housing and a closed position wherein the visual indicator is hidden within the slide housing; and a notch formed on an underside of the slide and an upwardly extending tab formed on the slide housing, wherein the upwardly extending tab engages the notch of the slide when the slide is in the open position to lock the slide in the open position. The slide is resiliently flexible and the slide is disengaged from the upwardly extending tab by deforming the slide relative to the slide housing.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
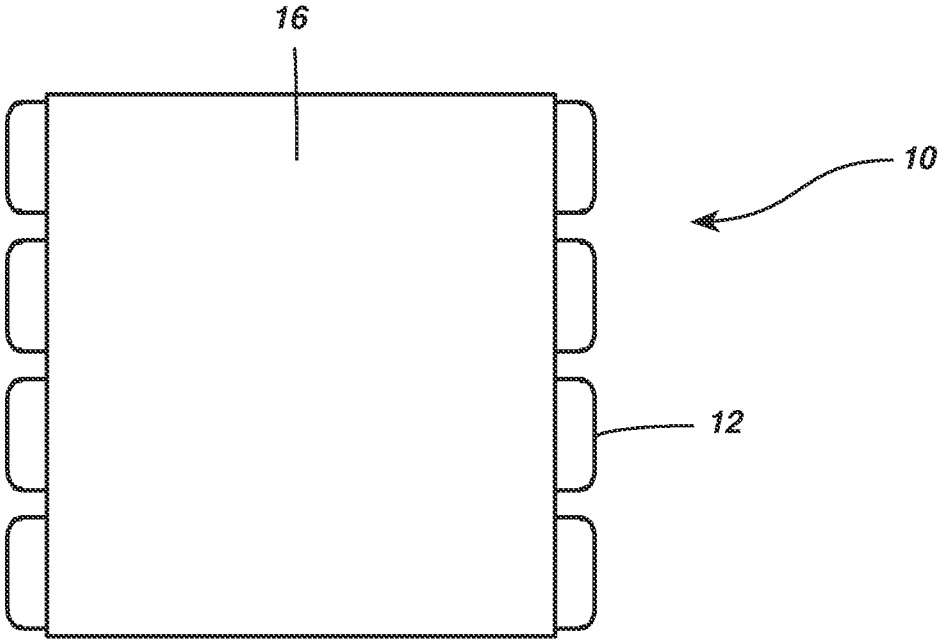
FIG. 1 shows a front view of a modular flag display according to one embodiment of the present disclosure.
Figure 2:
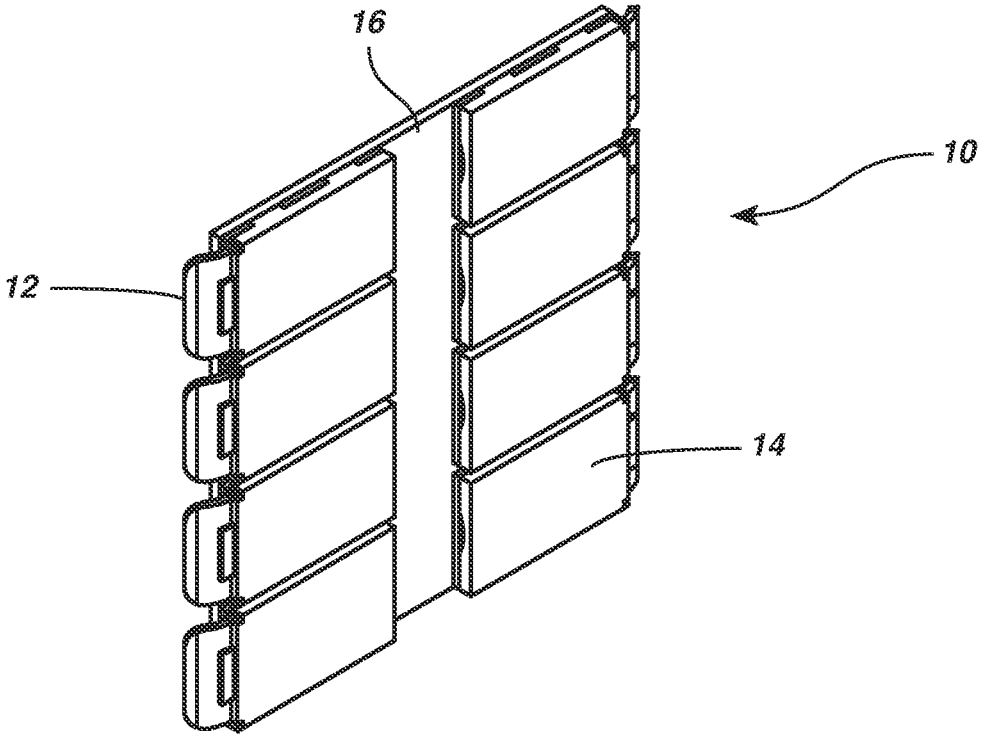
FIG. 2 shows perspective rear view of a modular flag display according to one embodiment of the present disclosure.

FIGS. 1 and 2 show a basic embodiment of a modular flag display 10 having a plurality of slides 12 that are each located within a corresponding slide housing 14. Each slide housing 14 is removably attached to a base 16. The base 16 is securable to a surface, preferably a wall adjacent to an entryway of a room or other location. The modular flag display 10 enables a user to pull one or more of the slides 12 from the slide housings 14 such that visual indicia on the slides 12 is viewable to a person viewing the modular flag display 10. Further, each of the modular slide housings 14 are swappable with other slide housings 14 containing slides 12 that have different visual indicia, and the slide housings 14 may be arranged in different configurations depending on mounting locations of the base 16.

Figure 3:
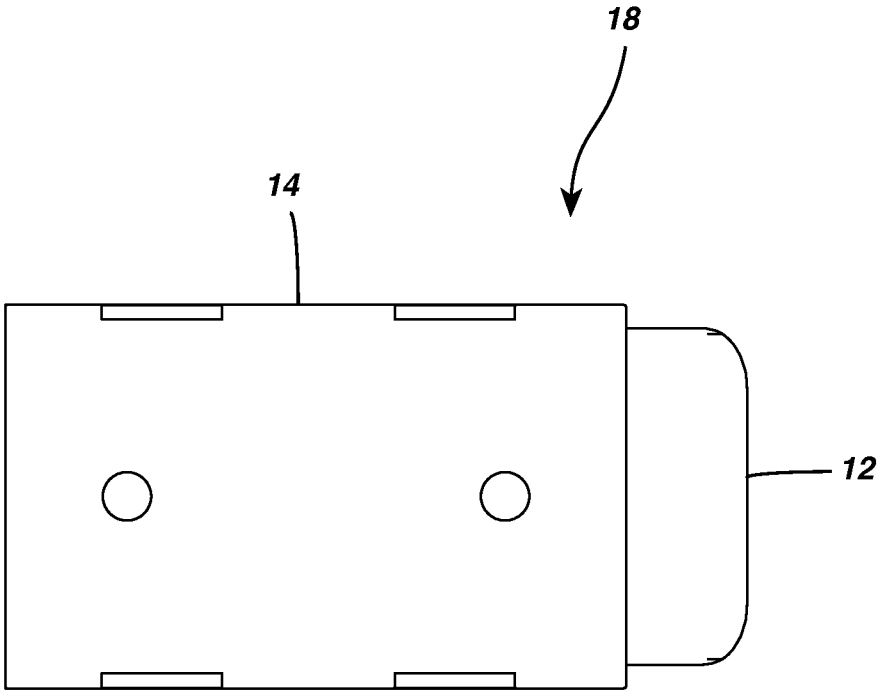
FIG. 3 shows a top view of a modular indicator unit of a modular flag display according to one embodiment of the present disclosure.
Figure 4:
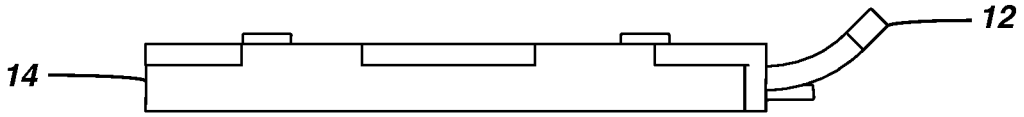
FIG. 4 shows a side view of a modular indicator unit of a modular flag display according to one embodiment of the present disclosure.
Figure 5:
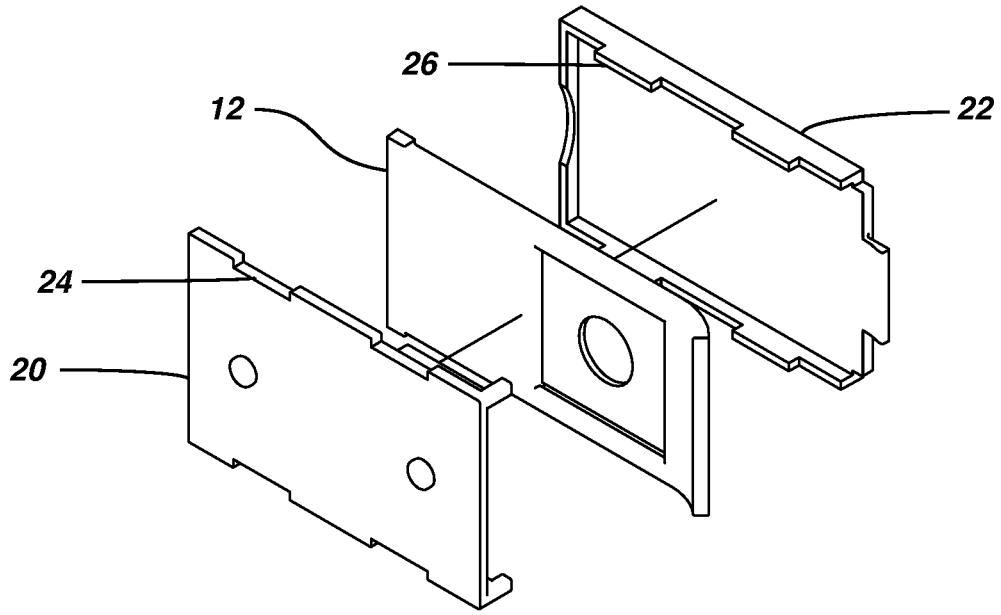
FIG. 5 shows an exploded front perspective view of a modular indicator unit of a modular flag display according to one embodiment of the present disclosure.
Figure 6:
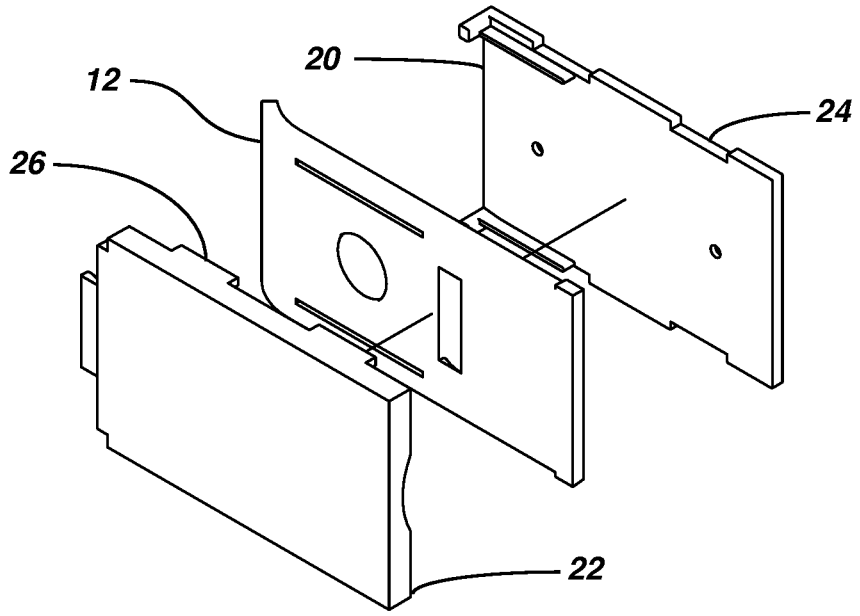
FIG. 6 shows an exploded rear perspective view of a modular indicator unit of a modular flag display according to one embodiment of the present disclosure.

Referring now to FIGS. 3 and 4, the slide 12 is engaged with the slide housing 14 such that the slide 12 and housing 14 together form a modular indicator unit 18. The modular indicator unit 18 is modular such that the modular indicator unit 18 is replaceable with other similar modular indicator units 18. The modular indicator unit 18 may include a particular flag, sign, or visual indicator that is displayed on the slide 12 when the slide 12 is exposed from the slide housing 14. Other of the modular indicator units 18 may include differing flags, signs, or visual indicators. Visual indicators within the modular indicator units 18 may be swapped depending on a desired flag, sign, or visual indicator to be displayed. Alternatively, the modular indicator units 18 may be swapped with one another depending on a desired location of each of the modular indicator on the base 16, The slide housing 14 is preferably formed of opposing halves that are secured together around the slide 12. Referring now to FIGS. 5 and 6, the slide 12 is located within the slide housing 14 between an upper housing portion 20 and a lower housing portion 22. The upper housing portion 20 and lower housing portion are preferably joined to one another with a snap fit or press fit engagement and may be further secured to one another with an adhesive. For example, the upper housing portion 20 may include a plurality of indentations 24 formed along sides of the upper housing portion 20 and the lower housing portion 22 may include a plurality of corresponding projections 26. The indentations 24 of the upper housing portion 20 preferably interlock with projections 26 of the lower housing portion 22 to secure the upper housing portion 20 to the lower housing portion 22 to form the housing 14. While the figures illustrate the plurality of indentations 24 formed on the upper housing portion 20 and the plurality of projections 26 formed on the lower housing portion 22, it is also understood that placement of the indentations 24 and projections 26 may be on either of the upper housing portion 20 and lower housing portion 22.

Figure 7:
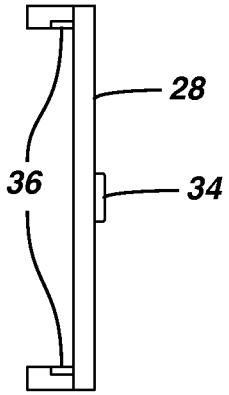
FIG. 7 shows a front view of an upper housing portion of a slide housing according to one embodiment of the present disclosure.
Figure 8:
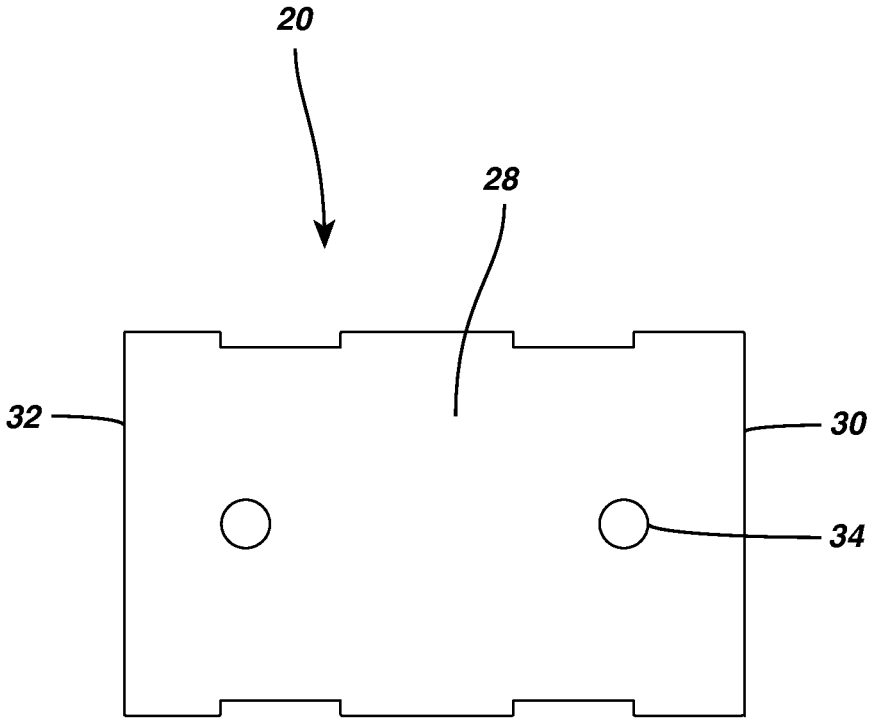
FIG. 8 shows a top view of an upper housing portion of a slide housing according to one embodiment of the present disclosure.
Figure 9:
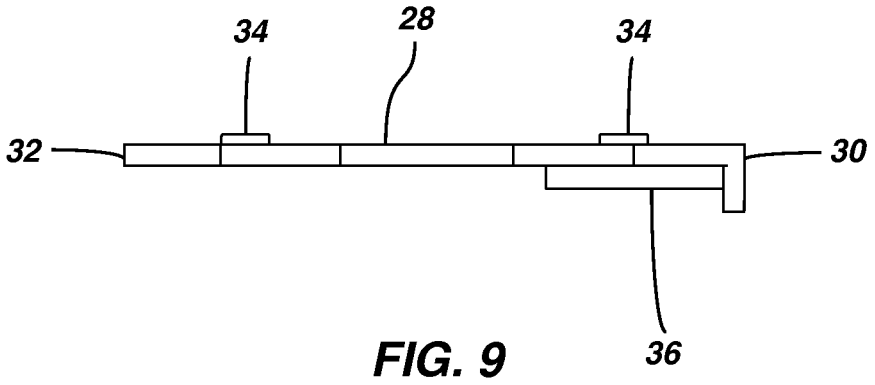
FIG. 9 shows a side view of an upper housing portion of a slide housing according to one embodiment of the present disclosure.

Referring now to FIGS. 7-9, the upper housing portion 20 includes a substantially planar member 28 including a front end 30 and a back end 32. One or more posts 34 are located on and extend upwardly from the planar member 28 of the upper housing portion 20. The one or more projections 34 are shaped to fit with corresponding apertures formed on the base 16 to secure the housing 14 as described in greater detail below. The upper housing portion 20 preferably includes a pair of opposing guide members 36 located along sides of the upper housing portion 20. The pair of opposing guide members 36 are preferably located towards the front end 30 of the planar member 28 and preferably extend only partially rearward from the front end 30 towards the back end 32 of the planar member 28. The pair of opposing guide members 36 are shaped to sliding contact sides of the slide 12 to guide the slide 12 during movement of the slide 12 from a position within the slide housing 14 to a position where visual indicia of the slide 12 is displayed.

Figure 10:
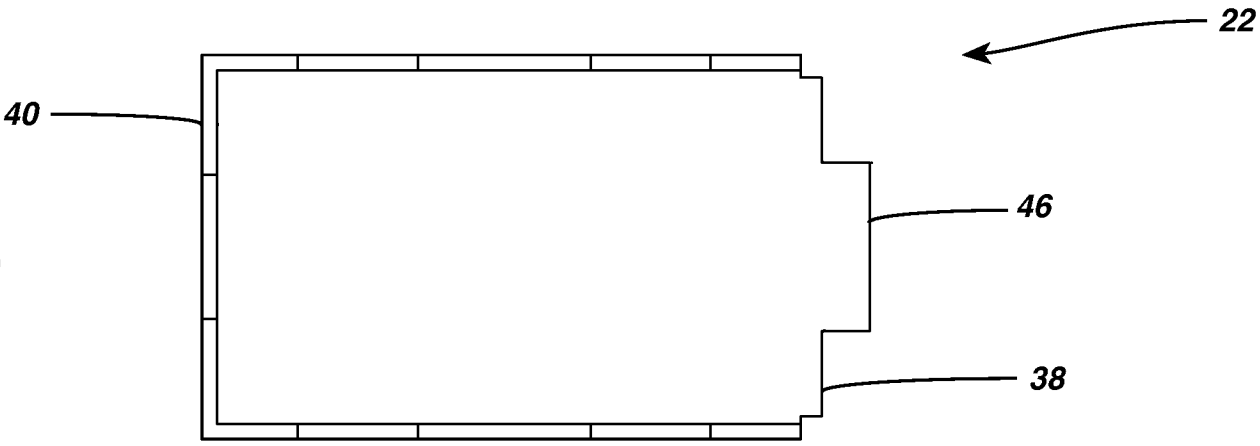
FIG. 10 shows a top view of a lower housing portion of a slide housing according to one embodiment of the present disclosure.
Figure 11:
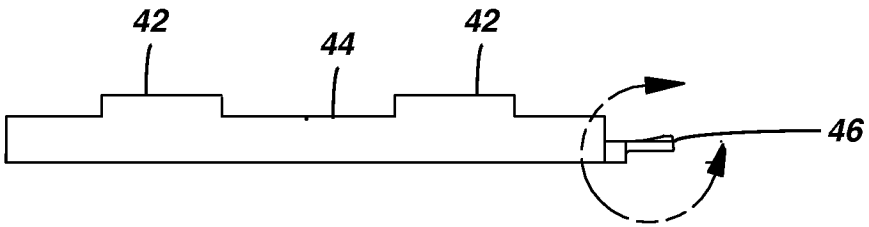
FIG. 11 shows a side view of a lower housing portion of a slide housing according to one embodiment of the present disclosure.
Figure 12:
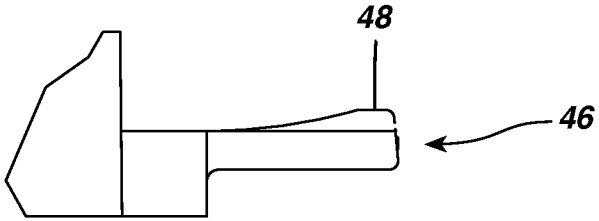
FIG. 12 shows a close-up view of a tab of a lower housing portion according to one embodiment of the present disclosure.
Figure 13:
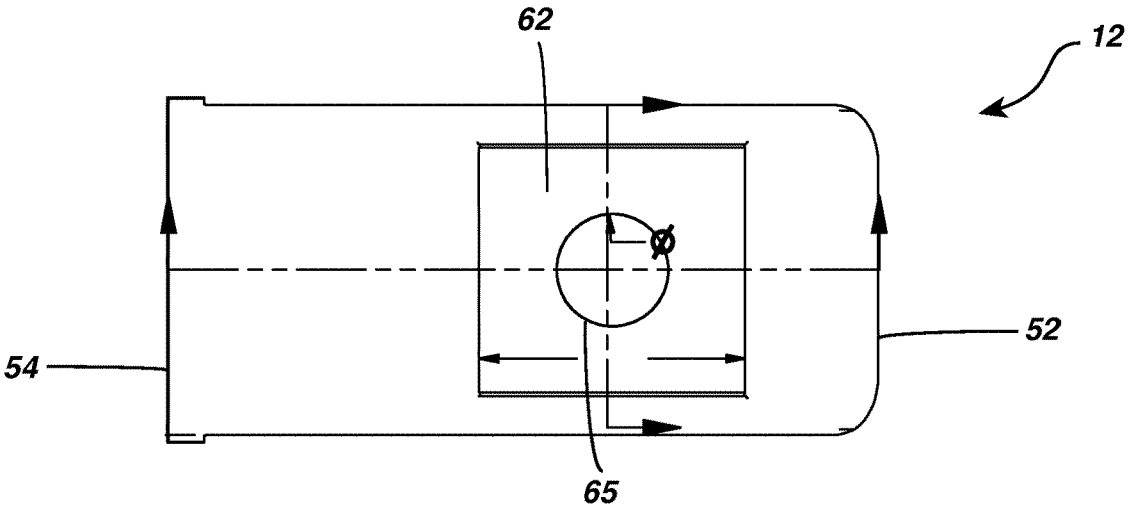
FIG. 13 shows a top view of a slide according to one embodiment of the present disclosure.

The lower housing portion 22, as illustrated in FIGS. 10-12, is shaped to fit with the upper housing portion 20 such that the upper housing portion 20 and lower housing portion 22 form the slide housing 14 containing the slide 12 therein. The lower housing portion 22 includes a planar portion including a front end 38 and a back end 40 that are aligned with the front end 30 and back end 32 of the upper housing portion 20. As shown in FIG. 11, projections 42 and indentations 44 along sides of the lower housing portion 22 are shaped to fit with the one or more projections 34 of the upper housing portion 20 to secure the upper housing portion 20 to the lower housing portion 22.

The lower housing portion 22 preferably includes a tab 46 projecting from the front end 38 of the lower housing portion 22. The tab 46 is shaped to engage the slide 12 when the slide 12 is extended to prevent the slide 12 from moving back into the slide housing 14 unless engaged by a user. Referring to FIG. 12, the tab 46 is shaped to engage the slide 12 such that the tab is biased towards allowing the slide 12 to extend while preventing the slide 12 from retracting into the slide housing 14, as described in greater detail below. The tab 46 preferably includes a raised distal end 48 and a sloped portion 50 that is sloped towards the raised distal end 48. The tab 46 is located on the lower housing portion 22 such that a bottom side of the slide 12 contacts the raised distal end 48 of the tab 46 when the slide 12 moves between extended and retracted positions with respect to the slide housing 14.

Referring to FIGS. 13-17, the slide 12 has a substantially elongate planar shape along a length of the slide 12 and preferably has a constant thickness along a length of the slide 12 such that the slide 12 fits within the slide housing 14. The slide 12 includes an upwardly curved end 52 that is shaped such that a user may grasp the curved end 52 of the slide 12 to pull the slide 12 from the slide housing 14. The slide 12 further preferably includes a flared end 54 that is distal from the upwardly curved end 52. The flared end 54 has a width such that the flared end 54 contacts the guide members 36 of the upper housing portion 20 when the slide 12 is extended from the slide housing 14 and to prevent the slide 12 from being pulled completely out of the slide housing 14.

Figure 14:
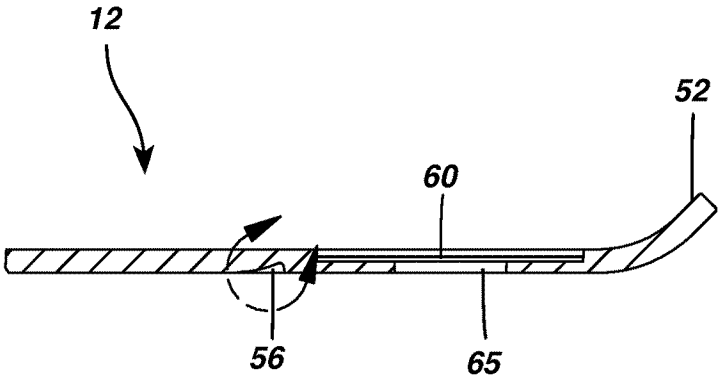
FIG. 14 shows a side view of a slide according to one embodiment of the present disclosure.
Figure 15:
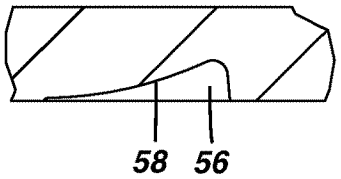
FIG. 15 shows a close-up view of a notch formed in an underside of a slide according to one embodiment of the present disclosure.

As shown in FIGS. 14 and 15, the slide 12 includes a notch 56 formed on an underside of the slide. The notch 56 is shaped to conform to a shape of the upward projecting tab 46 of the lower housing portion 22 such that when the tab 46 is aligned with the notch 56 the tab 46 engages the notch 56 to prevent the slide 12 from moving to the retracted position as described in greater detail below. The notch 56 preferably includes a sloped portion 58 that corresponds to the sloped portion 50 of the tab 46.

The slide 12 is adapted to display a visual indicator when the slide 12 is extended from the slide housing 14. A pocket 60 is preferably formed in the slide 12 that is shaped to contain at least one visual indicator to be displayed on the slide 12. A back 62 of the slide 12 is preferably located adjacent the pocket 60 to support a visual indicator within the pocket 60. Sides of the pocket include a lip 63 extending at least partially over the pocket 60 such that when a visual indicator is placed within the pocket 60 the lip 63 prevents the visual indicator from falling out of the pocket 60 as described in greater detail below. The slide 12 further includes an aperture 65 formed through the back 62 of the slide 12 to allow a user to press out a visual indicator secured in the pocket 60.

Referring again to FIGS. 5 and 6, the slide 12 and slide housing 14 are assembled such that the slide 12 is sandwiched between the upper housing portion 20 and the lower housing portion 22. The slide 12 and slide housing 14 together form the modular indicator unit 18 that may be installed on the base 16 in various configurations as described in greater detail below. The upwardly curved end 52 projects from an end of the slide housing 14 when the slide 12 is positioned within the slide housing 14. The slide 12 is engaged with the slide housing 14 such that the slide 12 moves between a closed or retracted position and an open or extended position.

Figure 18:
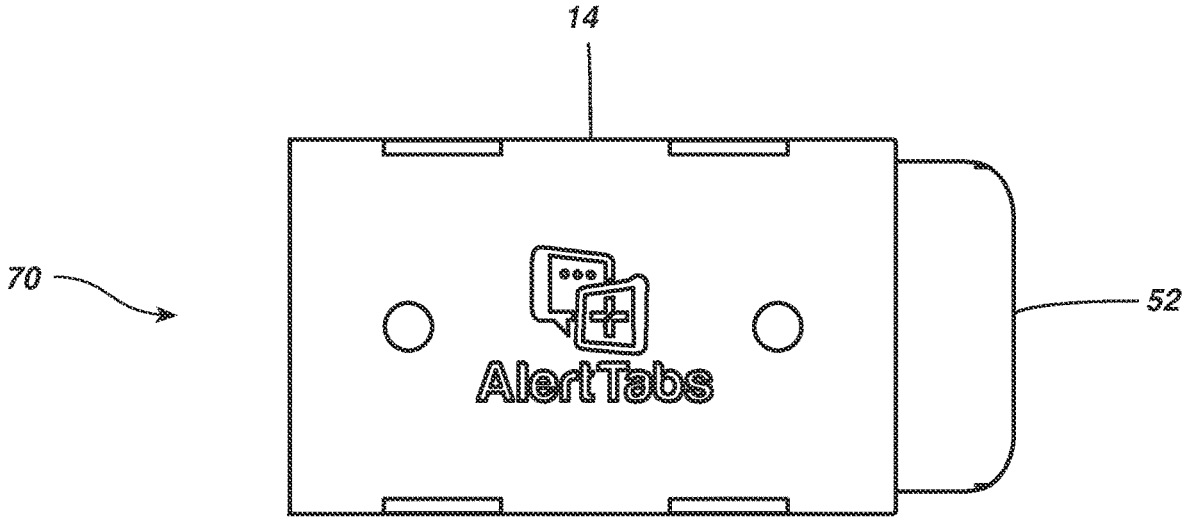
FIG. 18 shows a top view of a modular indicator unit in a closed position according to one embodiment of the present disclosure.
Figure 19:
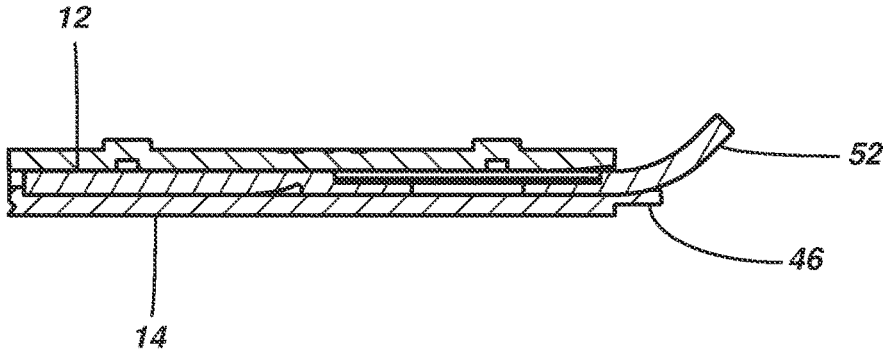
FIG. 19 shows a side view of a modular indicator unit in a closed position according to one embodiment of the present disclosure.

FIGS. 18 and 19 show the modular indicator unit 18 wherein the slide 12 is in the closed or retracted position within the slide housing 14. In the closed position, the slide 12 is substantially entirely contained within the slide housing 14 such that no visual indicators on the slide 12 are viewable outside of the slide housing 14. In the closed position, the sloped portion 50 of the tab 46 may contact an underside of the upwardly curved end 52 of the slide 12 to prevent the slide from freely moving from the closed position to the open position.

Figure 20:
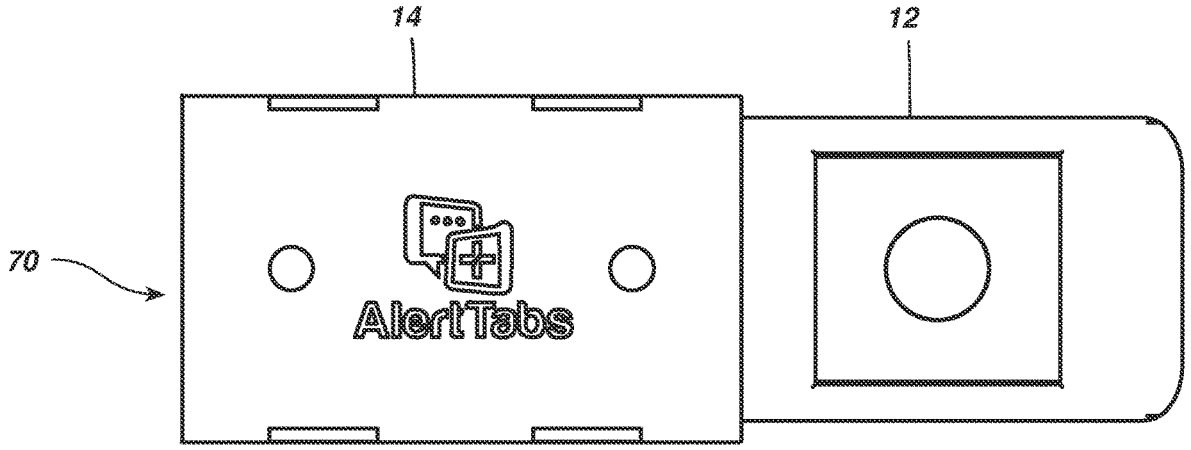
FIG. 20 shows a top view of a modular indicator unit in an open position according to one embodiment of the present disclosure.
Figure 21:
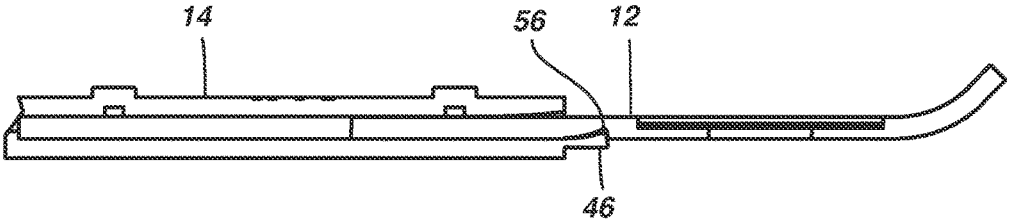
FIG. 21 shows a side view of a modular indicator unit in an open position according to one embodiment of the present disclosure.
Figure 22:
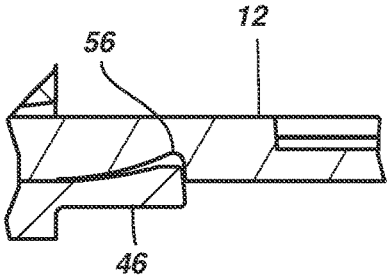
FIG. 22 shows a close-up view of a tab engaged with a notch of a slide when the slide is in an open position according to one embodiment of the present disclosure.

In the open or extended position illustrated in FIGS. 20-22, the slide 12 is substantially extended from the slide housing 14 such that any visual indicators on the slide 12 are viewable outside of the slide housing 14. In the open position, the flared end 54 contacts the guide members 36 of the upper housing portion 20 to prevent the slide 12 from being fully removed from the slide housing 14. In the open position, the upwardly extending tab 46 engages the notch 56 formed in the underside of the slide 12. When the tab 46 is engaged with the notch 56, a front end of the tab 46 contacts a portion of the notch 56 to prevent the slide 12 from moving from the open position to the closed position such that the slide 12 is locked in the open position. In the locked and open position, the slide 12 is unable to retract into the slide housing 14 unless appropriately manipulated by a user as described below.

Figure 23:
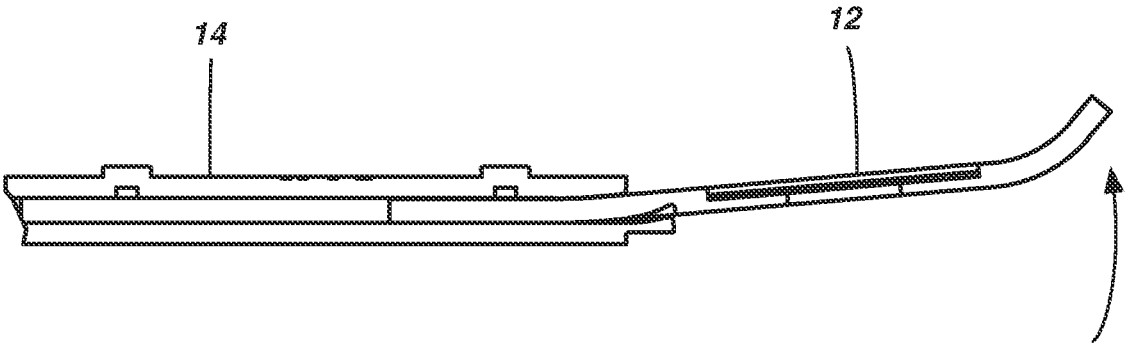
FIG. 23 shows a side view of a modular indicator unit disengaging a tab of a slide housing according to one embodiment of the present disclosure.
Figure 24:
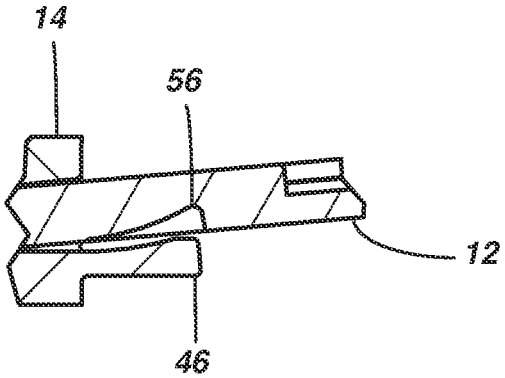
FIG. 24 shows a close-up view of a tab disengaging a notch on a slide according to one embodiment of the present disclosure.

When a user desires to move the slide 12 from the open and locked position to the closed position, the slide 12 may be released from the locked position by manipulation of the slide 12. Referring to FIGS. 23 and 24, a user may urge the slide 12 upward at the upwardly curved end 52, thereby causing the slide 12 deform and the tab 46 from the notch 56. After disengaging the tab 46 on the slide housing 14 from the notch 56 on the slide 12, the slide may be urged into the slide housing 14 until the slide 12 returns to the closed position within the slide housing 14.

Figure 25:
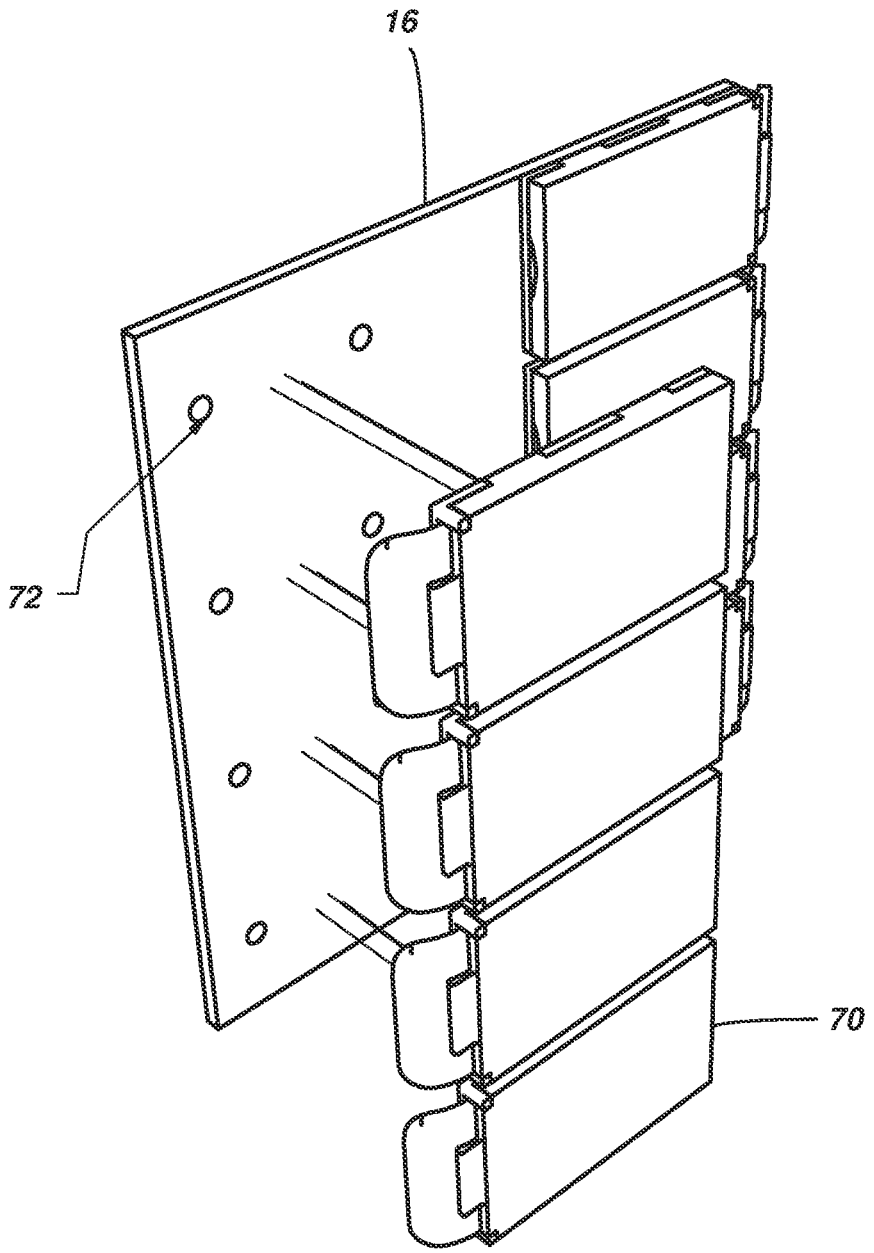
FIG. 25 shows a plurality of modular indicator units attached to a base according to one embodiment of the present disclosure.
Figure 28:
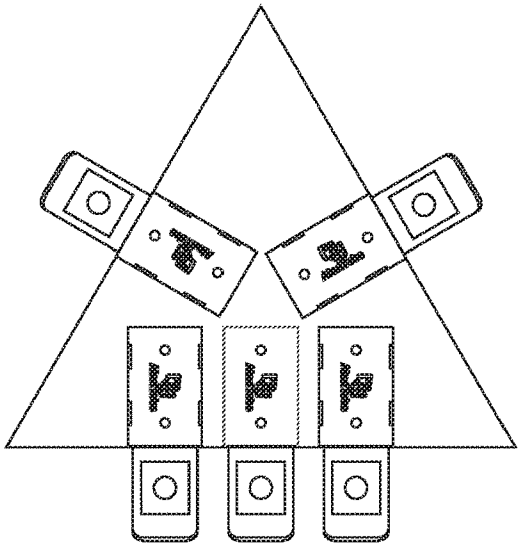
FIGS. 26-28 show arrangements of modular indicator units on various bases according to embodiments of the present disclosure.
Figure 27:
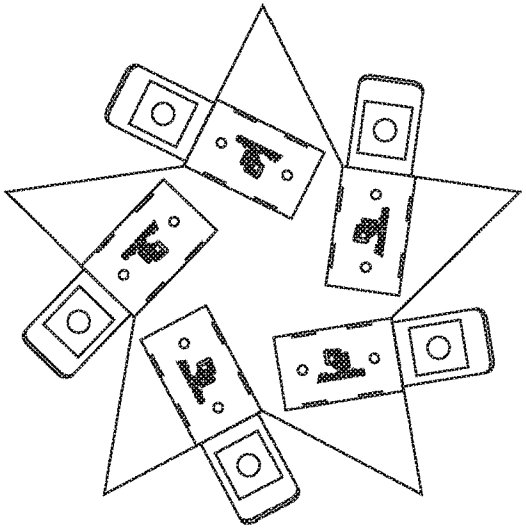
Figure 26:
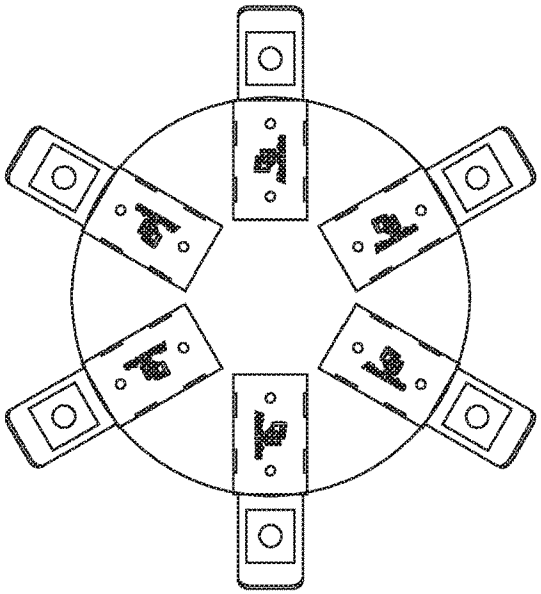

Each modular indicator unit 18 may include a different visual indicator and may be arranged on the base 16 in various configurations depending on desired visual indicators and a desired layout of the visual indicators. Referring to FIG. 25, the modular indicator unit 18 is removably attachable to the base 16. For example, the posts 34 of the slide housing 14 may engage apertures 72 formed in the base 16. The modular indicator unit 18 may be arranged on the base 16 as shown in FIG. 25. Alternative arrangements of the modular indicator unit 18 may be created using bases having varying shapes. For example, as shown in FIGS. 27-28 the base 16 may be shaped such that the modular indicator unit 18 are radially located around the base 16.

Figure 16:
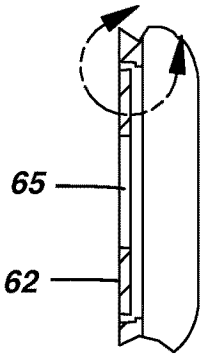
FIG. 16 shows a cross-sectional view of a slide according to one embodiment of the present disclosure.
Figure 17:
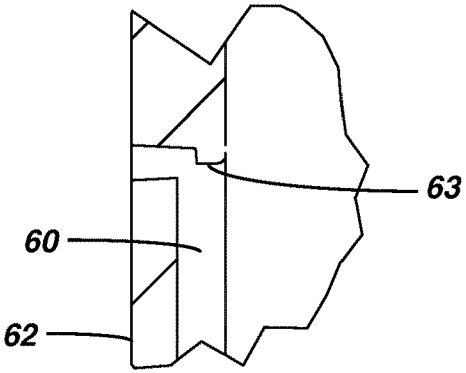
FIG. 17 shows a close-up view of a slide and transparent cover according to one embodiment of the present disclosure.
Figure 29:
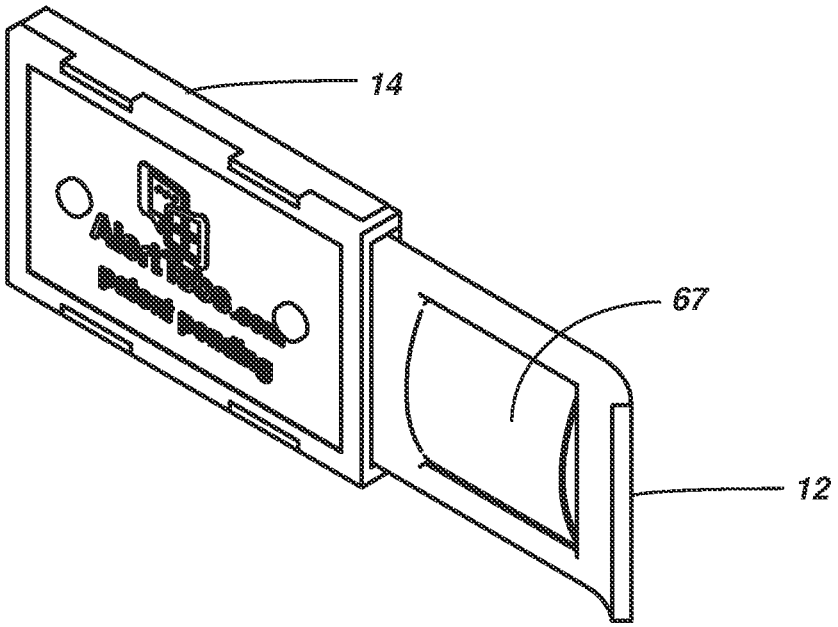
FIGS. 29-30 show installation and removal of a visual indicator on the slide according to one embodiment of the present disclosure.
Figure 30:
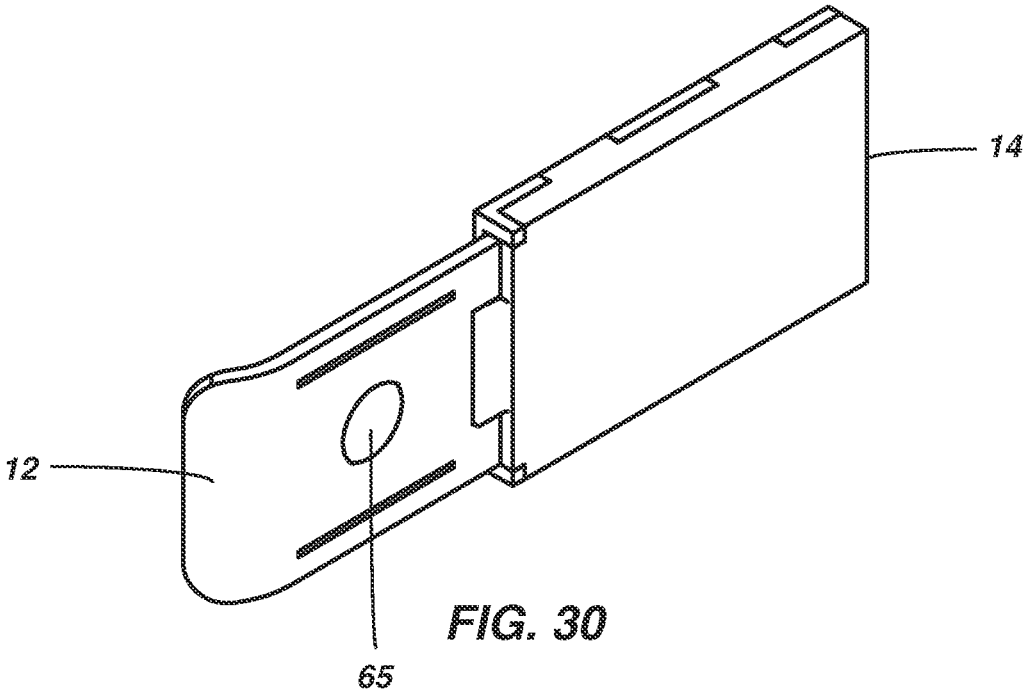
Figure 31:
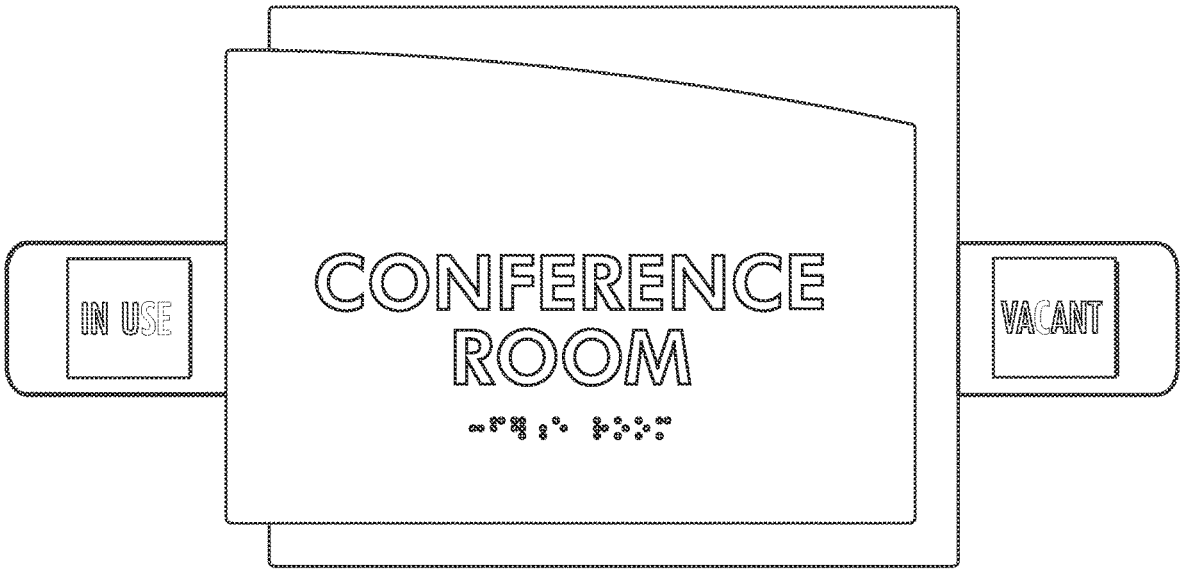
FIGS. 31-41 show varying arrangements of visual indicators on a modular flag display according to embodiments of the present disclosure.
Figure 32:
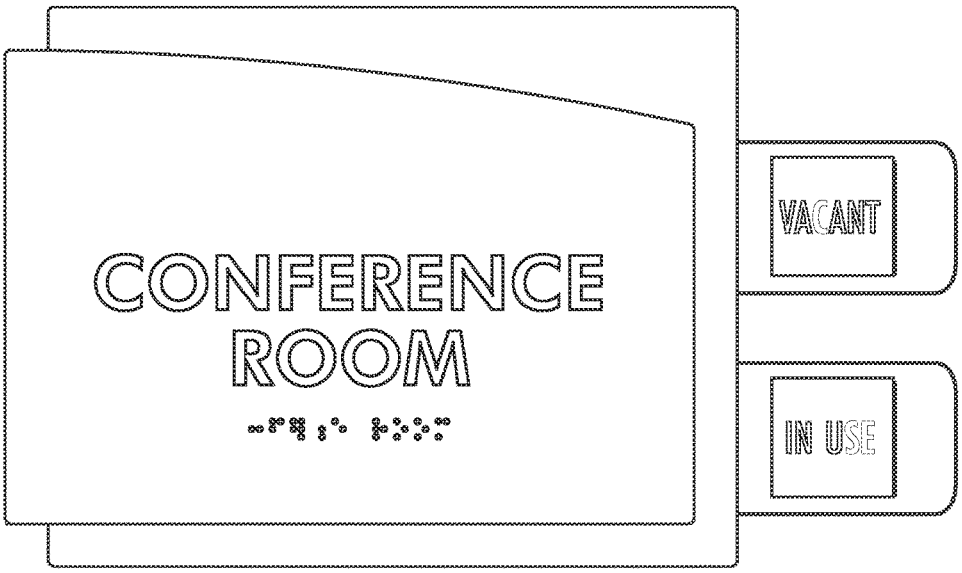
Figure 33:
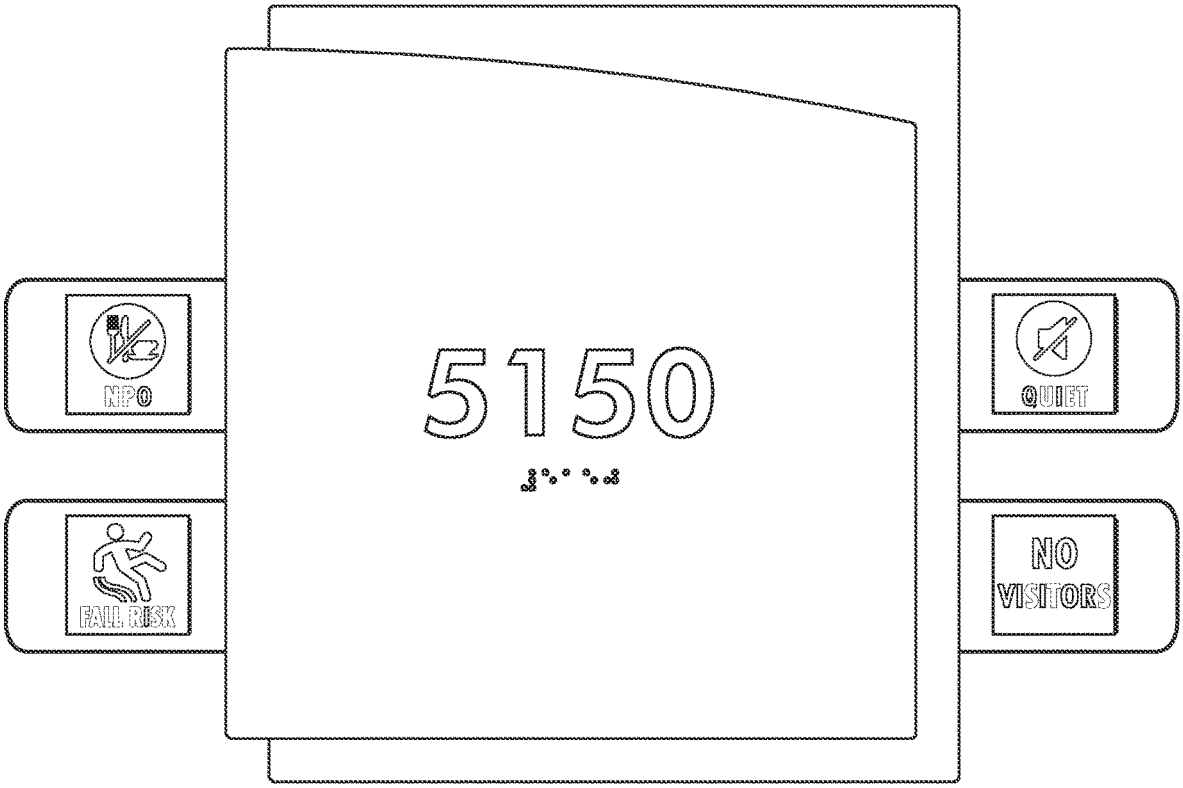
Figure 34:
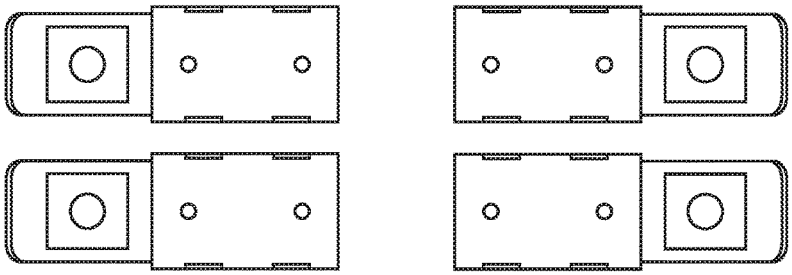
Figure 35:
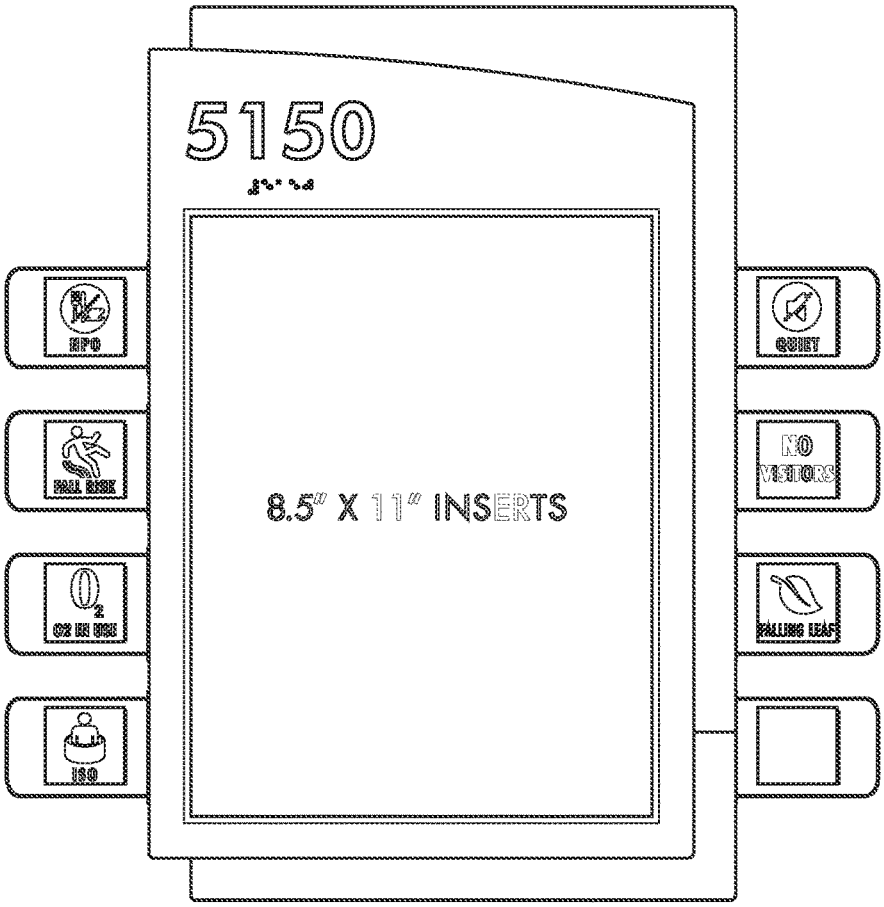
Figure 36:
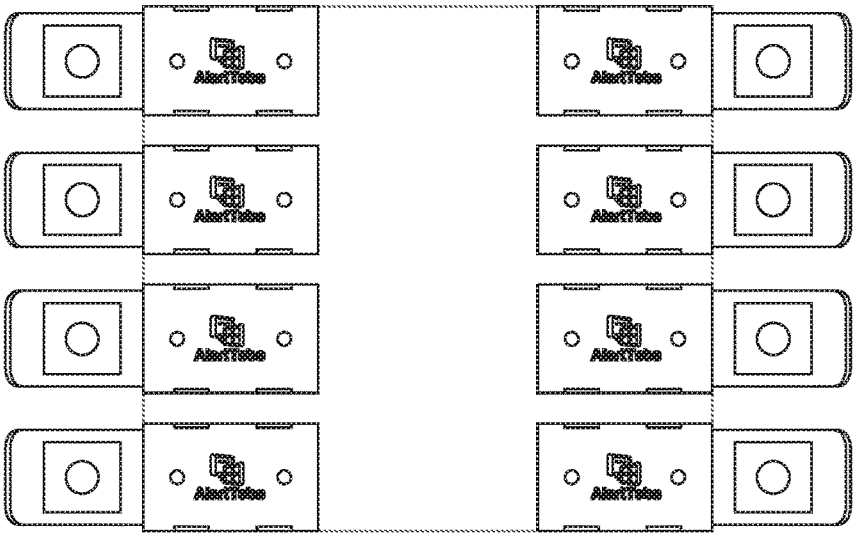
Figure 37:
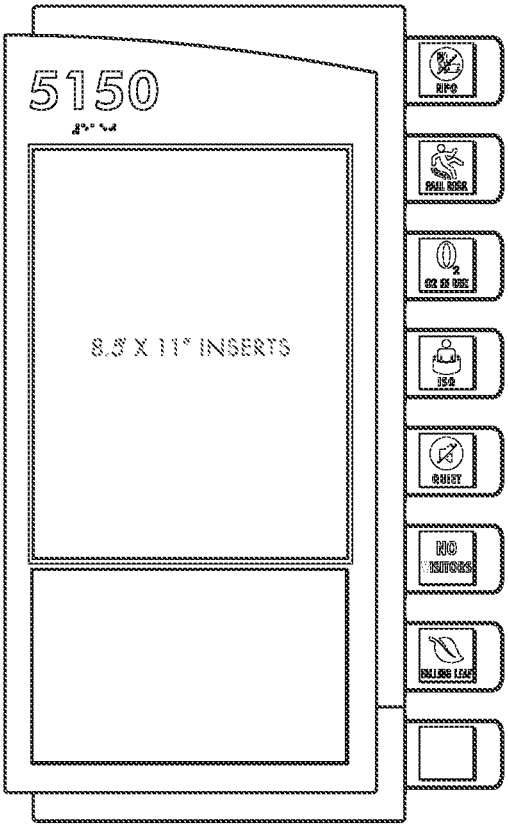
Figure 38:
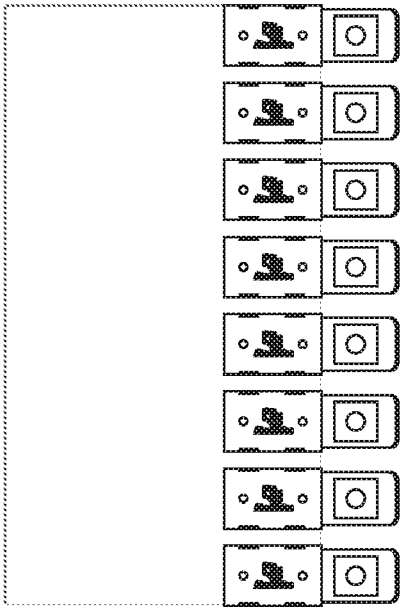
Figure 39:
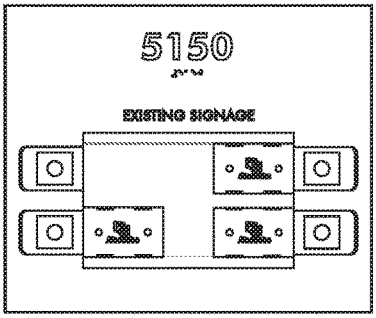
Figure 40:
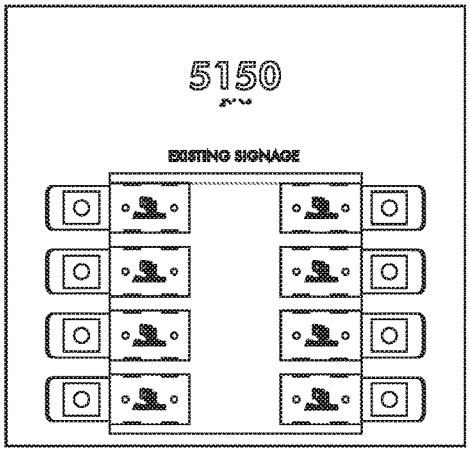
Figure 41:
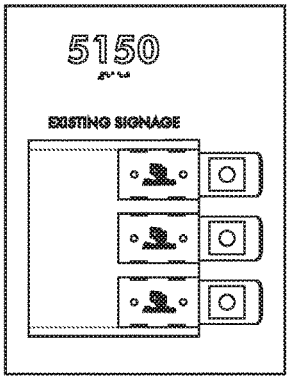

Visual indicators of the modular indicator units 18 may be readily swapped or exchanged with various other visual indicators. Referring to FIGS. 29 and 30, a visual indicator or icon 67 is shaped to fit within the pocket 60 of the slide. Further, the visual indicator 67 may be readily removed from the pocket 60 such that the visual indicator 67 may be swapped with other various indicators or icons that may be suitable for a particular location. To insert the visual indicator 67 into the pocket, the indicator is aligned with and pressed into the pocket 60. The visual indicator 67 is preferably formed of a resiliently flexible material and preferably has a width that is greater than a width of the lip 63 formed along sides of the pocket (FIGS. 16 and 17). When the visual indicator 67 is fully pressed into the pocket 60, the lip 63 extends over edges of the visual indicator 67 to maintain the visual indicator 67 within the pocket 60. To subsequently remove the visual indicator 67 from the slide 12, a user may insert a finger of the user through the aperture 65 formed through the back 62 of the slide 12 to pop the visual indicator out of the pocket 60.

Referring now to FIGS. 31-41, various visual indicators may be suitable for display on the slides 12 depending on a location of the modular flag display 10. For example, visual indicators may display whether a room is in use or vacant, whether a patient is to receive food or fluids or poses a fall risk, and other various indicators providing information to a viewer of the modular flag display 10. The modular indicator unit 18 may be arranged in various configurations depending on a desired configuration of the modular flag display 10. The modular flag display 10 may be combined with existing signage or indicators such that the existing signage is enhanced with user-selectable visual indicators that may be deployed from the modular flag display. The modular flag display 10 may be further combined with various other sign elements, such as a cork or marker board portion.

The modular flag display of the present disclosure advantageously allows for customized configuration of a sign adjacent to an entryway of a room or in another location where signage may be desired. The modular indicator units 18 are readily interchangeable with other modular indicator units such that visual indicators may be placed in various suitable locations on a sign. The modular flag display further allows visual indicators to be easily displayed while locking those indicators in place in the displayed position to prevent inadvertent movement of the visual indicators while also allowing a user to easily manipulate the visual indicator into the closed position.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A visual indicator display device comprising:

a base;

a plurality of modular indicator units removably attached to the base, the plurality of modular indicator units including a slide housing attachable to the base, the modular indicator unit including an open end formed thereon;

a slide located within the slide housing and extending at least partially from the open end of the slide housing, the slide including a visual indicator viewable on the slide, wherein the slide is movable between an open position such that the visual indicator is visible outside of the slide housing and a closed position wherein the visual indicator is hidden within the slide housing.

2. The visual indicator display device of claim 1 further comprising a notch formed on an underside of the slide and an upwardly extending tab formed on the slide housing, wherein the upwardly extending tab engages the notch of the slide when the slide is in the open position to lock the slide in the open position.

3. The visual indicator display device of claim 2, the slide further comprising an upwardly curved end located on an end of the slide that extends out of the slide housing.

4. The visual indicator display device of claim 3, wherein the upwardly extending tab contacts the upwardly curved end of the slide to prevent the slide from freely moving to the open position.

5. The visual indicator display device of claim 2, wherein the slide is resiliently flexible and wherein the slide is disengaged from the upwardly extending tab by deforming the slide relative to the slide housing.

6. The visual indicator display device of claim 2, wherein the notch of the slide and the upwardly extending tab of the slide housing are biased towards securing the slide in the open position.

7. The visual indicator display device of claim 1, the slide further including a pocket formed therein for receiving the visual indicator within the pocket.

8. The visual indicator display device of claim 7, the slide further including an aperture formed through the pocket of the slide behind the visual indicator.

9. The visual indicator display device of claim 7, the slide further including a lip formed along sides of the pocket for retaining the visual indicator within the pocket.

10. The visual indicator display device of claim 1, the slide housing further including one or more posts extending outwardly therefrom, the one or more posts shaped to engage one or more corresponding holes formed in the base.

11. The visual indicator display device of claim 10, wherein the one or more holes formed in the base are arranged to receive the one or more posts of the plurality of modular indicator units in a plurality of locations on the base.

12. A visual indicator display device comprising:

a base;

a plurality of modular indicator units removably attached to the base, the plurality of modular indicator units including a slide housing attachable to the base, the modular indicator unit including an open end formed thereon;

a slide located within the slide housing and extending at least partially from the open end of the slide housing, the slide including a visual indicator viewable on the slide, wherein the slide is movable between an open position such that the visual indicator is visible outside of the slide housing and a closed position wherein the visual indicator is hidden within the slide housing;

a notch formed on an underside of the slide and an upwardly extending tab formed on the slide housing, wherein the upwardly extending tab engages the notch of the slide when the slide is in the open position to lock the slide in the open position.

13. The visual indicator display device of claim 12, the slide further comprising an upwardly curved end located on an end of the slide that extends out of the slide housing.

14. The visual indicator display device of claim 13, wherein the upwardly extending tab contacts the upwardly curved end of the slide to prevent the slide from freely moving to the open position.

15. The visual indicator display device of claim 12, wherein the notch of the slide and the upwardly extending tab of the slide housing are biased towards securing the slide in the open position.

16. The visual indicator display device of claim 12, wherein the slide is resiliently flexible and wherein the slide is disengaged from the upwardly extending tab by deforming the slide relative to the slide housing.

17. The visual indicator display device of claim 12, the slide further including a pocket formed therein for receiving the visual indicator within the pocket.

18. The visual indicator display device of claim 17, the slide further including an aperture formed through the pocket of the slide behind the visual indicator.

19. The visual indicator display device of claim 17, the slide further including a lip formed along sides of the pocket for retaining the visual indicator within the pocket.

20. A visual indicator display device comprising:

a base;

a plurality of modular indicator units removably attached to the base, the plurality of modular indicator units including a slide housing attachable to the base, the modular indicator unit including an open end formed thereon;

a slide located within the slide housing and extending at least partially from the open end of the slide housing, the slide including a visual indicator viewable on the slide and an upwardly curved end located on an end of the slide that extends out of the slide housing, wherein the slide is movable between an open position such that the visual indicator is visible outside of the slide housing and a closed position wherein the visual indicator is hidden within the slide housing; and a notch formed on an underside of the slide and an upwardly extending tab formed on the slide housing, wherein the upwardly extending tab engages the notch of the slide when the slide is in the open position to lock the slide in the open position;

wherein the slide is resiliently flexible and wherein the slide is disengaged from the upwardly extending tab by deforming the slide relative to the slide housing.

* * * * *